US006079389A

United States Patent [19]

Ono et al.

[11] Patent Number: 6,079,389

[45] Date of Patent: Jun. 27, 2000

[54] CONTROL APPARATUS FOR CONTROLLING ENGINE DRIVING WATERCRAFT

[75] Inventors: Masato Ono, Shioya-gun; Shigeaki Kuwabara; Sadafumi Shidara, both of Wako, all of Japan

[73] Assignees: Keihin Corporation; Honda Giken Kogyo Kabushiki Kaisha, both of Tokyo, Japan

[21] Appl. No.: 09/170,999

[22] Filed: Oct. 14, 1998

[30] Foreign Application Priority Data

Nov. 25, 1997 [JP] Japan ..... 9-322717
Sep. 3, 1998 [JP] Japan ..... 10-249274

[51] Int. Cl.[7] ..... F02D 41/14; F02M 23/06

[52] U.S. Cl. ..... 123/352; 440/87

[58] Field of Search ..... 123/339.22, 339.23, 123/352–356; 440/84, 87

[56] References Cited

U.S. PATENT DOCUMENTS 4,877,003 10/1989 Shimomura et al. ..... 123/352 X
5,463,993 11/1995 Livshits et al. ..... 123/352 X
5,586,535 12/1996 Syomura ..... 123/352

*Primary Examiner*—Tony M. Argenbright
*Attorney, Agent, or Firm*—Arent Fox Kintner Plotkin & Kahn PLLC

[57] ABSTRACT

A control apparatus for controlling an engine mounted on a watercraft and driving it so as to finely and stably control a low speed of the watercraft. The control apparatus is adapted to compute a target engine speed on the basis of a correction value for the engine speed which is determined by a correction signal generated by a correction signal generator which is manually operable. The control apparatus controls the opening degree of the secondary air valve in accordance with a desired opening computed on the basis of the computed target engine speed.

4 Claims, 3 Drawing Sheets

CONTROL APPARATUS FOR CONTROLLING ENGINE DRIVING WATERCRAFT

BACKGROUND OF THE INVENTION

1. Field of the Invention

The present invention relates to a control apparatus for controlling an engine driving a watercraft.

2. Description of Related Art

While a small fishing boat or another watercraft is trolling or following a fish shoal at a stable and low speed, the watercraft needs such operation with its speed low and controlled delicately. Usually, the watercraft speed is controlled with a throttle lever. The throttle stroke covers a wide range of speed control. Therefore, while the watercraft is moving at constant low speed as stated above, part of the stroke needs manipulating delicately.

As stated above, it is necessary to finely control the watercraft speed by delicately manipulating the stroke of the throttle lever of the engine driving the watercraft while the engine drives the watercraft at a stable and low speed for trolling for fish or the like. This, in cooperation with the pitching, rolling and/or vibration of the hull, may make it difficult to manipulate the stroke.

OBJECT AND SUMMARY OF THE INVENTION

In view of the foregoing circumstances, it is an object of the invention to provide an engine controller which makes the speed of a watercraft easy to control finely.

According to the present invention, there is provided with a control apparatus for controlling the engine speed of an engine driving a watercraft and having a secondary air for supplying a secondary air at a portion downstream of the throttle valve thereof, which comprises: reference engine speed establishing means for establishing a reference engine speed in accordance with at least the temperature of said engine; signal generating means for generating a correction signal representing a correction value, while it is manually operated; target speed computing means for computing a target engine speed in accordance with said reference engine speed and said correction signal; opening computing means for computing the opening degree of said secondary air in accordance with said target engine speed; and control means for controlling the opening degree of said secondary air valve in accordance with the computed opening degree.

BRIEF DESCRIPTION OF THE DRAWINGS

A preferred embodiment of the invention will be described with reference to the accompanying drawings, in which.

DETAILED DESCRIPTION OF A PREFERRED EMBODIMENT

Figure 1:
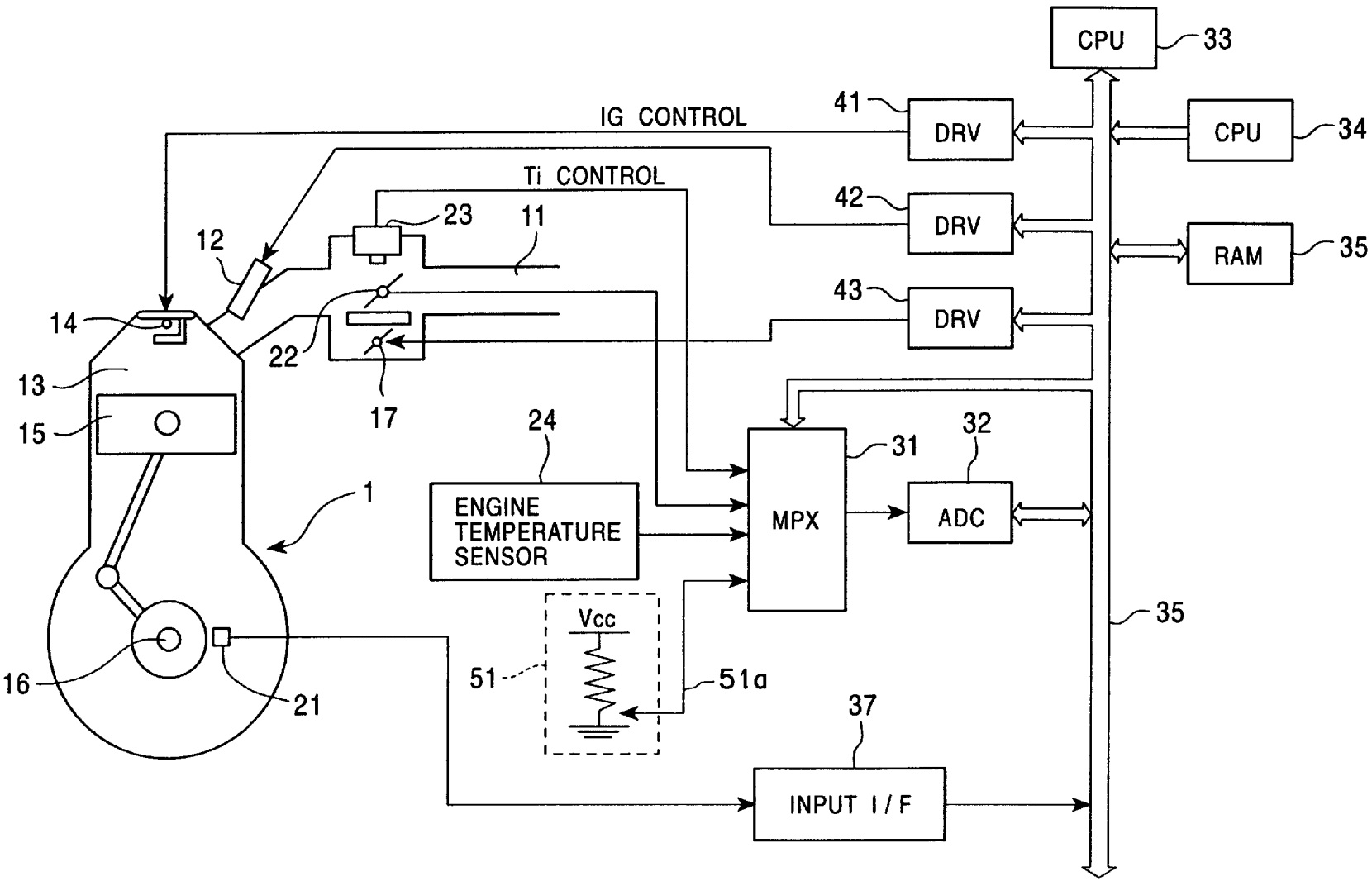
FIG. 1 is a block diagram of a control apparatus embodying the invention for controlling an internal combustion engine driving a watercraft.

With reference to FIG. 1, a control apparatus is shown which controls an internal combustion engine 1 as an engine mounted on a watercraft and driving it. The engine includes a suction pipe 11, an injector 12, a combustion chamber 13, an ignition plug 14, a piston 15 and a crankshaft 16. Air sucked through the pipe 11 and fuel injected from the injector 12 are mixed into a gaseous mixture. The mixture is sucked into the chamber 13, where it is burned by spark discharge from the plug 14, enlarging in volume. The enlarged volume moves the piston 15 down. The movement of the piston 15 is transmitted to the crankshaft 16 to rotate the crankshaft.

A secondary air supply system includes a secondary air valve 17, through which outside air can be supplied to a downstream portion of a throttle valve provided at the suction pipe 11.

A crankshaft reference position detector 21 is positioned near the crankshaft 16, and can supply reference position signals to an input interface 37. The interface 37 shapes the waveform of the signals, and then supplies them to an input/output bus 36.

A throttle valve sensor 22 detects the opening of the throttle valve in the suction pipe 11. An intake pressure sensor 23 detects the pressure in the pipe 11. An engine temperature sensor 24 detects the temperature of the engine 1. The sensors 22, 23 and 24 supply sensor signals to a multiplexer 31.

The multiplexer 31 is connected to a voltage output terminal of a manual lever 51*a* of a correction signal generator 51, which can generate a correction voltage signal according to a correction value for correcting the engine speed as stated later. The manual lever 51*a* may be installed around a driver's seat of a watercraft (not shown) for the sake of the manual operation by the driver. The generator 51 includes a variable resistor, which can be operated externally to divide the voltage supplied from a constant voltage source (not shown). The voltage from the divider is supplied as a correction voltage signal to the multiplexer 31. The multiplexer 31 is a switch for supplying an A/D converter 32 selectively with one of the signals from the sensors 22–24 and the correction signal from the generator 51 in accordance with a command output from a CPU 33 at a predetermined time.

The A/D converter 32 is connected through the I/O bus 36 to the CPU 33. Data and address signals can be input to and output from the CPU 33 through the bus 36.

The I/O bus 36 is connected to a ROM 34, a RAM 35, and drive circuits 41, 42 and 43 for the ignition plug 14, injector 12 and secondary air valve 17, respectively.

Figure 2:
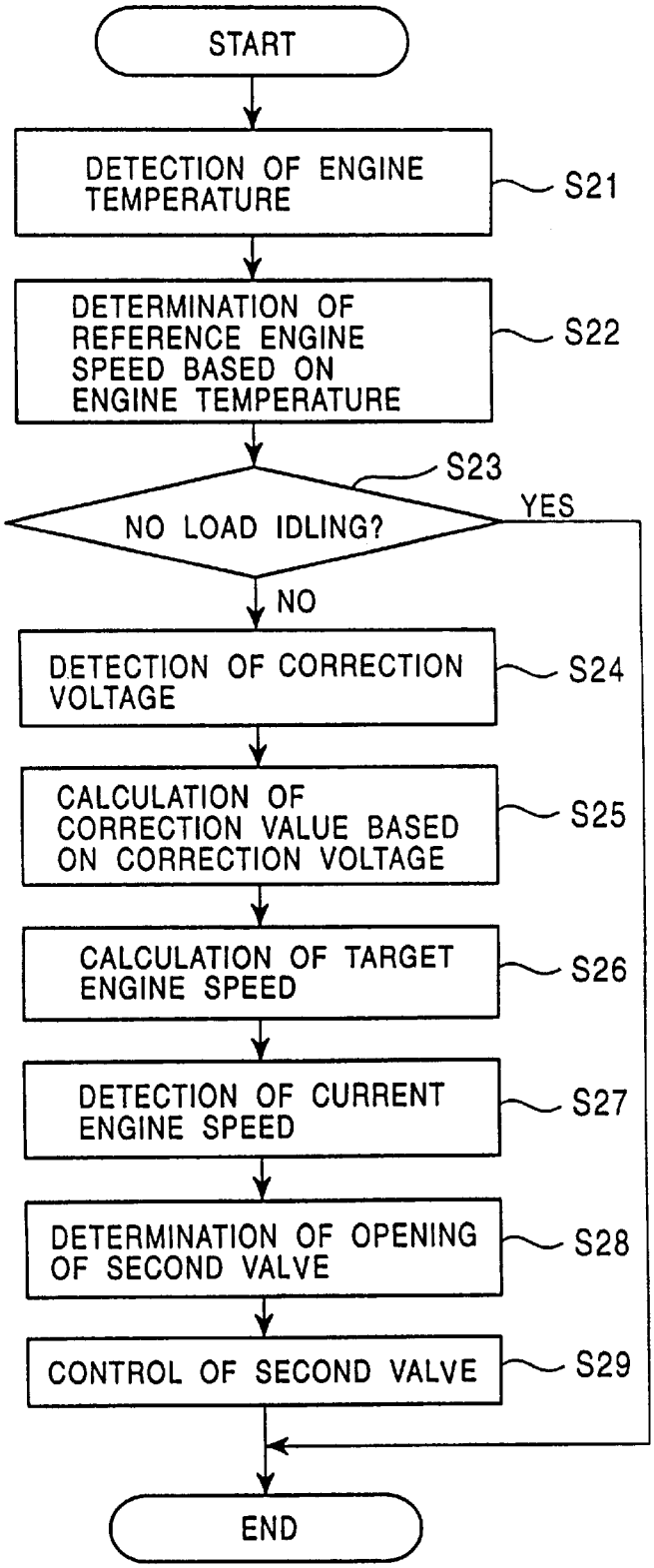
FIG. 2 is a flowchart of a process for controlling the rotational speed of the engine in the embodiment shown in FIG. 1.

The ROM 34 stores the programs for carrying out the process shown in FIG. 2.

The ROM 34 also stores a map determining the relationship between engine temperature and reference engine speed. The map is used to find out the reference engine speed based on a particular engine temperature detected by the sensor 24 (FIG. 2, S22).

The ROM 34 further stores a map determining the relationship between desired engine speed, present engine speed and secondary air valve opening. A number of desired engine speeds are calculated in advance as targets for engine speed control. This map is used to find out the opening of the secondary air valve 17 on the basis of a particular desired engine speed and the present engine speed (FIG. 2, S28).

The CPU 33, ROM 34 and RAM 35 constitute a means of desired engine speed calculation, a means of opening calculation and a means of opening instruction.

The CPU 33 calculates the present engine speed from reference position signals output from the crankshaft reference position detector 21.

FIG. 2 shows a subroutine for engine speed control according to the invention. The subroutine interrupts at a predetermined time into a main routine in the CPU 33.

The subroutine includes detecting the engine temperature with the sensor 24 (Step S21).

With reference to the map determining the relationship between engine temperature and reference engine speed, the reference engine speed is selected for the detected temperature (Step S22).

Next, it is judged whether the engine is idling or not (Step S23). If it is judged that the engine is idling, the subroutine ends.

If it is judged that the engine is not idling, the correction voltage signal from the correction signal generator 51 is detected (Step S24).

Figure 3:
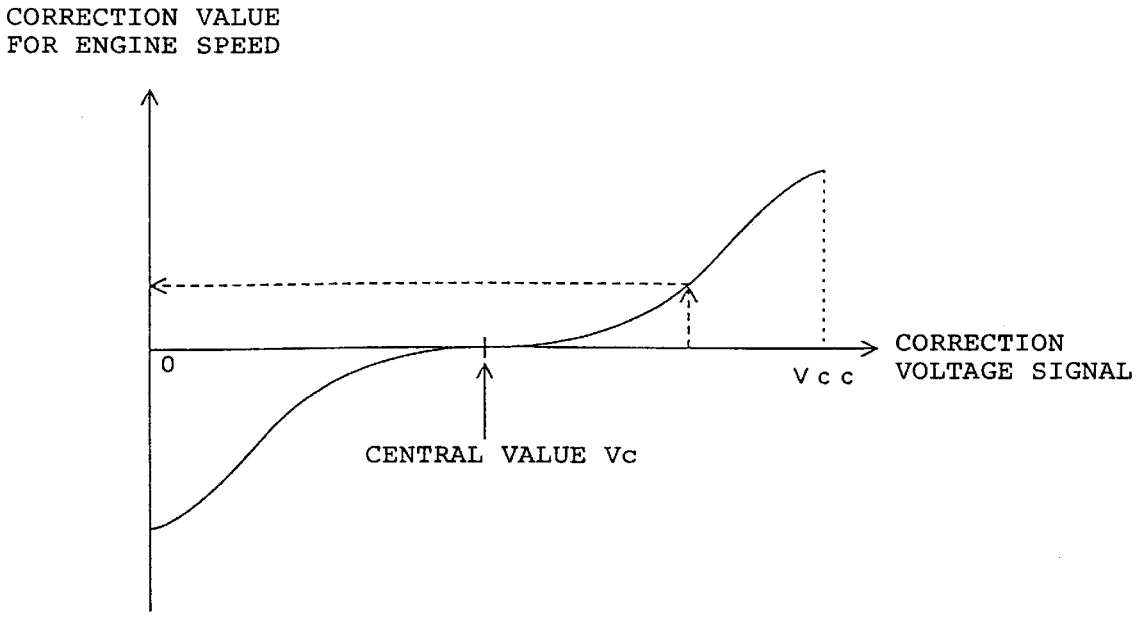
FIG. 3 is a graph showing relationship between correction signals and correction values for correcting the engine speed.

With reference to the relationship shown in FIG. 3, the correction value of engine speed is found out on the basis of the detected correction signal (Step S25).

The reference engine speed selected at Step S22 and the correction value found at Step S25 are added to make a desired engine speed (Step S26). As shown in FIG. 3, the correction value is minus if the correction voltage signal is lower than a medium voltage, while the correction value is plus if the correction signal is higher than this voltage. Therefore, the engine speed can decrease if the correction signal is lower, while the speed can increase if the signal is higher. As also shown in FIG. 3, the correction value changes at a lower rate if the correction signal is near the medium voltage Vc. Therefore, if the correction signal is near the medium voltage, it is easier to control the engine speed finely.

Next, the present engine speed is detected from reference position signals output from the crankshaft reference position detector 21 (Step S27).

On the basis of the desired engine speed calculated at Step S26 and the detected present engine speed, the opening of the secondary air valve 17 is selected from the map stored in the ROM 34 (Step S28).

In accordance with the selected opening, the secondary air valve driver 43 is controlled so that the actual opening of the secondary air valve coincide with the selected opening (Step S29). Then, the subroutine ends.

By thus controlling the valve driver 43 at Step S29, it is possible to control the amount of secondary air supplied to the engine and to consequently control the engine speed so that the actual engine speed follows the target engine speed calculated on the basis of the manual lever position and the reference engine speed.

It might be preferred to provide an initialization means such as a spring for mechanically and constantly urging the manual lever 51*a* of the correction signal generator 51 toward a home position (zero position).

It is to be noted that even though the correction signal generator 51 is constituted by a constant voltage source and a variable resistor in the embodiment mentioned above, it may be constituted by a signal generator which is manually operable.

As mentioned above, it can be readily accomplished to finely and stably control a relatively low speed of a watercraft by using an engine control apparatus according to the present invention.

What is claimed is:

1. A control apparatus for controlling the engine speed of an engine driving a watercraft and having a secondary air valve for supplying a secondary air at a portion downstream of the throttle valve thereof, which comprises:

reference engine speed establishing means for establishing a reference engine speed in accordance with at least the temperature of said engine;

signal generating means for generating a correction signal representing a correction value, while it is manually operated;

target speed computing means for computing a target engine speed in accordance with said reference engine speed and said correction signal;

opening computing means for computing the opening degree of said secondary air valve in accordance with said target engine speed; and control means for controlling the opening degree of said secondary air valve in accordance with the computed opening degree.

2. A control apparatus according to claim 1, which further comprises: means for prohibiting such control of the actual opening of said secondary air valve as to make the actual opening to coincide with an opening corresponding to said target engine speed.

3. A control apparatus according to claim 1, in which said correction signal generating means is adapted to produce as said correction signal a voltage signal obtained by dividing a constant voltage by means of a variable resistor.

4. A control apparatus according to claim 3, in which said correction signal generating means includes a manual lever mechanically urged toward a home position, said lever is connected to said variable resistor so that the resistance of said variable resistor is varied in accordance with the position of said lever.

* * * * *